US011441361B2

(12) United States Patent
Ishizuka et al.

(10) Patent No.: US 11,441,361 B2
(45) Date of Patent: Sep. 13, 2022

(54) CUTTER BIT

(71) Applicant: METAL TOOL INC., Nagoya (JP)

(72) Inventors: Takemi Ishizuka, Nagoya (JP); Yohei Iwanaga, Kuwana (JP)

(73) Assignee: METAL TOOL INC.

( * ) Notice: Subject to any disclaimer, the term of this patent is extended or adjusted under 35 U.S.C. 154(b) by 0 days.

(21) Appl. No.: 17/251,680

(22) PCT Filed: Jun. 24, 2019

(86) PCT No.: PCT/JP2019/024864
§ 371 (c)(1),
(2) Date: Dec. 11, 2020

(87) PCT Pub. No.: WO2020/004294
PCT Pub. Date: Jan. 2, 2020

(65) Prior Publication Data

US 2021/0254411 A1 Aug. 19, 2021

(30) Foreign Application Priority Data

Jun. 26, 2018 (JP) ..... JP2018-120543

(51) Int. Cl.
*E21B 10/58* (2006.01)
*E21B 10/02* (2006.01)
*E21B 7/20* (2006.01)

(52) U.S. Cl.
CPC ..... *E21B 10/58* (2013.01); *E21B 10/02* (2013.01); *E21B 7/20* (2013.01)

(58) Field of Classification Search
CPC ..... E21B 7/20; E21B 10/58; E21B 10/633; E21B 10/02; E21B 10/42; E21B 10/46; E21B 10/48; E21B 10/62
See application file for complete search history.

(56) References Cited

U.S. PATENT DOCUMENTS 3,999,620 A * 12/1976 Watson ..... B23B 51/0406 175/403
6,187,068 B1 * 2/2001 Frushour ..... B01J 3/062 407/118

FOREIGN PATENT DOCUMENTS

JP H03-290587 A 12/1991
JP H04-319195 A 11/1992
JP H08-093375 A 4/1996
JP H10-306674 A 11/1998
(Continued)

*Primary Examiner* — Giovanna Wright
*Assistant Examiner* — Ronald R Runyan
(74) *Attorney, Agent, or Firm* — Harness, Dickey & Pierce, P.L.C.

(57) ABSTRACT

A casing-tube cutter bit applicable to both-directional rotation and having high excavation performance is provided. A casing-tube cutter bit includes a mounting part constituted by two members facing each other at a predetermined interval, and an excavation part formed continuously with the mounting part and having a leading end at which a plurality of ultrahard chips are disposed at a predetermined interval, the excavation part includes a central part, and first and second tilt parts tilted on both sides of the central part, the first tilt part is formed in a first length at a first tilt angle, the second tilt part is formed in a second length at a second tilt angle, the first tilt angle is equal to the second tilt angle, and the first length is shorter than the second length.

10 Claims, 9 Drawing Sheets

(56) References Cited

FOREIGN PATENT DOCUMENTS

| | | | |
|---|---|---|---|
| JP | 2002-322892 | A | 11/2002 |
| JP | 2012-241459 | A | 12/2012 |

* cited by examiner

CUTTER BIT

CROSS-REFERENCE TO RELATED APPLICATIONS

This application is a U.S. National Phase application of International Application No. PCT/JP2019/024864, filed on Jun. 24, 2019, which claims priority to Japanese Patent Application No. 2018-120543, filed on Jun. 26, 2018. The entire disclosures of the above applications are expressly incorporated by reference herein.

BACKGROUND

Technical Field

The present invention relates to a casing-tube cutter bit.

Related Art

Conventionally, what is called an all-casing method of inserting a casing tube into the earth by pressing, performing excavation and earth-sand removal with a grab bucket while protecting a hole wall, and placing concrete in a hole formed through excavation has been typically known as a piling method of placing concrete in the earth to form a pile. In the all-casing method, inner-blade, middle-blade, and external-blade cutter bits are attached to a leading end of the casing tube through bit attachment holders, and the casing tube is rotated to achieve excavation by the cutter bits.

A conventional shield-machine cutter bit (refer to Japanese Patent Laid-Open No. 2016-223196, for example) includes a body member and a plurality of ultrahard chips as plate pieces fixed to the body member, the body member includes a body base part and a plurality of holding walls extending from the body base part in a cut direction and forming, between holding walls adjacent to each other, a predetermined gap linearly extending in a direction intersecting a circumferential direction, and the plurality of ultrahard chips include a plurality of first ultrahard chips each mounted and fixed in the predetermined gap and a pair of second ultrahard chips fixed to one and the other end parts of the body base part in the circumferential direction.

However, the disclosure of Japanese Patent Laid-Open No. 2016-223196 is a shield-machine cutter bit but not a casing-tube cutter bit. Furthermore, there has been no conventionally casing-tube cutter bit in which a plurality of ultrahard bits are disposed at a predetermined interval and that is applicable to both-directional rotation.

The present invention is intended to solve such a problem and provide a casing-tube cutter bit applicable to both-directional rotation and having high excavation performance.

SUMMARY

To solve the above-described problem, a cutter bit according to a first aspect of the present invention is a casing-tube cutter bit including: a mounting part constituted by two members facing each other at a predetermined interval; and an excavation part having a fan shape, formed continuously with the mounting part, and having a leading end at which a plurality of ultrahard chips are disposed at a predetermined interval in a comb shape symmetric with respect to a central line in a longitudinal direction and symmetric with respect to a central line in a circumferential direction, the excavation part includes a central part extending in a radial direction of the casing tube on a side opposite to a side of mounting on the casing tube in the longitudinal direction, and first and second tilt parts that are disposed on both sides of the central part in an opposite direction with respect to a circumferential direction of the casing tube and are tilted toward the side of mounting on the casing tube in the longitudinal direction, the first tilt part is formed in a first length at a first tilt angle relative to a plane of the central part, the second tilt part is formed in a second length at a second tilt angle relative to the plane of the central part, the first tilt angle is equal to the second tilt angle, the first length is shorter than the second length, and at least one of the plurality of ultrahard chips is made of a material different from materials of the other ultrahard chips.

A cutter bit according to a second aspect of the present invention is a casing-tube cutter bit including: a mounting part constituted by two members facing each other at a predetermined interval; and an excavation part having a fan shape, formed continuously with the mounting part, and having a leading end at which a plurality of ultrahard chips are disposed at a predetermined interval in a comb shape symmetric with respect to a central line in a longitudinal direction and symmetric with respect to a central line in a circumferential direction, the excavation part includes a central part extending in a radial direction of the casing tube on a side opposite to a side of mounting on the casing tube in the longitudinal direction, and first and second tilt parts that are disposed on both sides of the central part in an opposite direction with respect to a circumferential direction of the casing tube and are tilted toward the side of mounting on the casing tube in the longitudinal direction, the first tilt part is formed in a first length at a first tilt angle relative to a plane of the central part, the second tilt part is formed in a second length at a second tilt angle relative to the plane of the central part, the first tilt angle is equal to the second tilt angle, the first length is equal to the second length, and at least one of the plurality of ultrahard chips is made of a material different from materials of the other ultrahard chips.

Advantageous Effects of Invention

According to the present invention, it is possible to provide a casing-tube cutter bit applicable to both-directional rotation and having high excavation performance.

DETAILED DESCRIPTION

Inner-blade, middle-blade, and external-blade cutter bits according to an embodiment of the present invention have at least characteristics as follows.

Firstly, although ultrahard chips are disposed only at minimum necessary parts in a conventional casing-tube cutter bit, ultrahard chips are disposed on all excavation surfaces in inner-blade, middle-blade, and external-blade cutter bits according to the present embodiment.

Secondly, the parent materials of inner and external blades have a tilt angle of 5° to reduce internal and external pressure of a casing. Specifically, the tilt angle is set to be 5° with taken into consideration the degree of protrusion from outer and inner plates of a casing tube and reduction of earth pressure on the casing tube.

Thirdly, material and hardness combinations for a plurality of ultrahard chips disposed on excavation surfaces of inner-blade, middle-blade, and external-blade cutter bits, which are mounted on the casing tube through a bit attachment holder, may be freely set as appropriate in accordance with an excavation target.

Fourthly, inner-blade, middle-blade, and external-blade cutter bits are applicable to both-directional rotation, have tilted excavation surfaces, and have what is called a comb shape in which ultrahard bits are arrayed at a predetermined interval, thereby enhancing excavation performance.

The configuration and effects of a casing-tube cutter bit according to the embodiment of the present invention will be described below in detail with reference to the accompanying drawings.

Inner-Blade Cutter Bit

Figure 1:
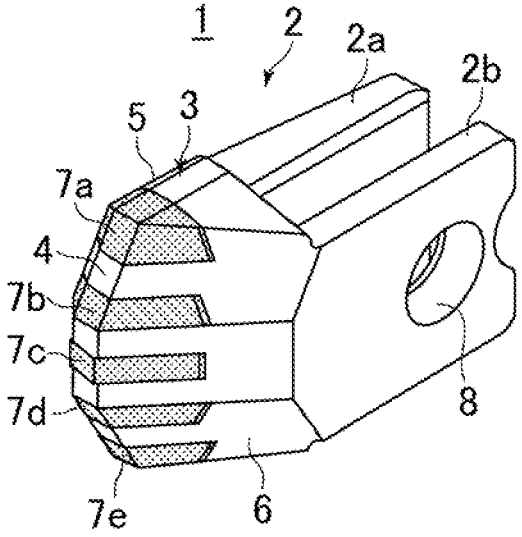
FIG. 1 is a perspective view of an inner-blade cutter bit according to an embodiment of the present invention.
Figure 2A:
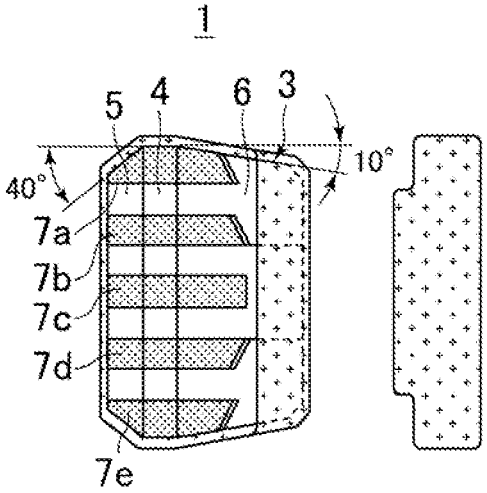
FIGS. 2A-2D are configuration diagrams of the inner-blade cutter bit according to the embodiment of the present invention.
Figure 2B:
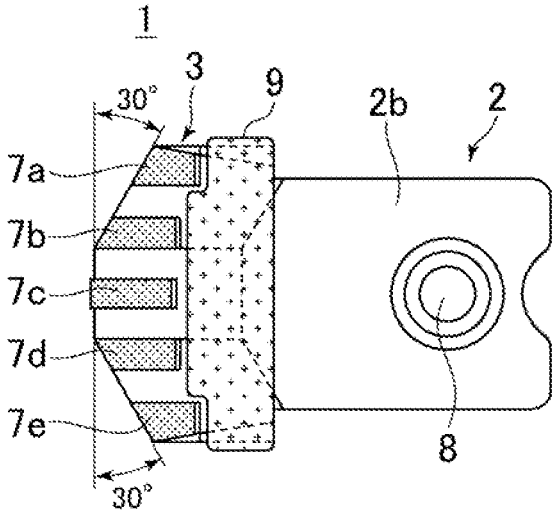
Figure 2C:
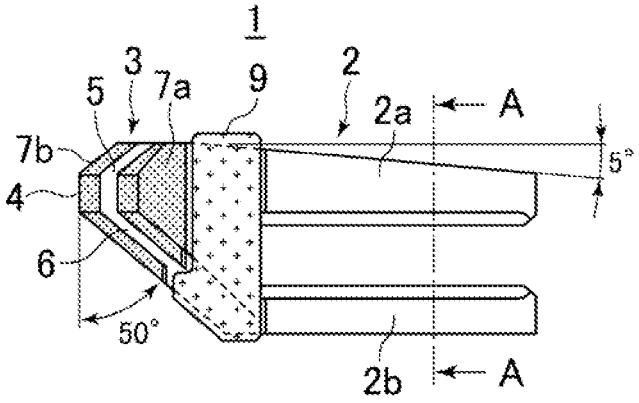
Figure 2D:
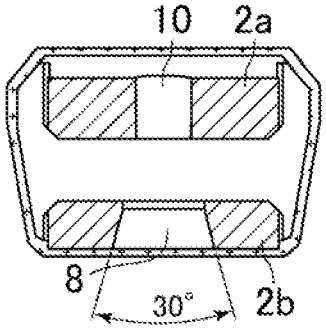

FIGS. 1 and 2A—2D illustrate the configuration of an inner-blade cutter bit according to the embodiment of the present invention. FIG. 1 is a perspective view of the cutter bit, FIG. 2A is a front view thereof, FIG. 2B is a side view thereof, FIG. 2C is a plan view thereof, and FIG. 2D is a cross-sectional view thereof taken along line A-A.

As illustrated in the drawings, an inner-blade cutter bit 1 includes a mounting part 2 constituted by two flat-plate members 2*a* and 2*b* facing each other at a predetermined interval, and an excavation part 3 formed continuously with the mounting part 2 and having a leading end at which a plurality of ultrahard chips 7*a* to 7*e* are disposed at a predetermined interval in a comb shape. The excavation part 3 includes, when a leading end part thereof is viewed from a front side as illustrated in FIG. 2A, a central part 4 extending at the center in a longitudinal direction, and a first tilt part 5 and a second tilt part 6 tilted on both sides of the central part 4.

In this example, the first tilt part 5 of the excavation part 3 is formed in a first length at a first tilt angle, the second tilt part 6 of the excavation part 3 is formed in a second length at a second tilt angle, the first tilt angle is 50°, which is equal to the second tilt angle, and the first length is shorter than the second length. When the leading end part thereof is viewed from a side surface as illustrated in FIG. 2B, the excavation part 3 has what is called a substantially fan shape tilted at a tilt angle of 30° upward and downward from a substantial center of the leading end part. Each side surface of the excavation part 3 is divided into three regions in FIGS. 1 and 2A—2D, but is not limited thereto.

A hard building-up 9 is formed in a region of the excavation part 3 in which the ultrahard bits 7*a* to 7*e* are not disposed. This functions to reduce abrasion of the excavation part 3 at excavation. When the excavation part 3 is viewed from the front side as illustrated in FIG. 2A, upper and lower ends of the first tilt part 5 of the excavation part 3 are tilted at 40° relative to upper and lower planes at end parts of the central part 4 of the excavation part 3 and upper and lower ends of the second tilt part 6 of the excavation part 3 are tilted at 10° relative to the upper and lower planes. This is a structure for parrying earth pressure at excavation by the first tilt part 5 and causing excavated earth and sand to smoothly flow.

Accordingly, although the casing-tube cutter bit according to the conventional technology is applicable to one-directional rotation only and has a shape that allows use of ultrahard chips of one material, the excavation part 3 of the cutter bit 1 according to the present embodiment has such a comb shape that allows use of the ultrahard chips 7*a* to 7*e* of five materials at maximum, and thus one cutter bit is applicable to a wide range of excavation targets.

In addition, since the excavation part 3 has a comb shape and a fan shape, the wide angle of 30° is applied as a contact surface angle for excavation as described above, which can reduce losses of the ultrahard chips 7*a* to 7*e* disposed at the excavation part 3.

In addition, since the excavation part 3 has a comb shape and a fan shape, the right and left sides of the ultrahard chip 7*c* disposed at the center can equally contact an excavation target. As for contact surfaces, each surface on the first tilt part 5 side serves as an inner contact surface, and the second tilt part 6 reduces excavation earth pressure and impact and withstanding pressure of obstacles such as concrete, steel bars, and steel beams.

One member 2*a* of the mounting part 2 continuous with the first tilt part 5 side of the excavation part 3 has an outer surface tilted inward at a tilt angle of 5°. Accordingly, internal pressure and external pressure applied to the cutter bit 1 are reduced. Specifically, the tilt angle is set to be 5° with taken into consideration the degree of protrusion from outer and inner plates of the casing tube and reduction of earth pressure on the casing tube.

The two members 2*a* and 2*b* of the mounting part 2 are provided with openings 8 and 10 for bolt insertion and nut fastening when the cutter bit 1 is mounted on a bit attachment holder 40.

As for materials, the parent material of the mounting part 2 may be SCM440 (chromium/molybdenum steel) or the like, and the material of each of the ultrahard chips 7*a* to 7*e* may be E3 (material name: MG30), E4 (material name: MG40), E5 (material name: MG50), E6 (material name: MG60), or the like in JIS classification codes, or G4 (CIS material code: VC-40), G5 (CIS material code: VC-50), or the like in CIS standards. The material of the hard building-up 9 may be HF (hard facing) 800 or the like.

Middle-Blade Cutter Bit

Figure 3:
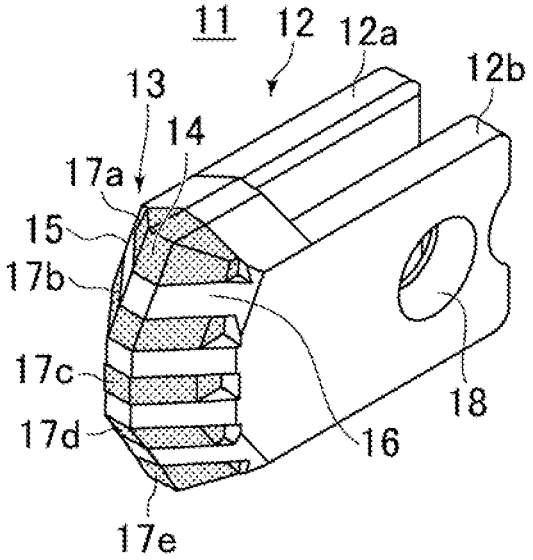
FIG. 3 is a perspective view of a middle-blade cutter bit according to the embodiment of the present invention.
Figure 4A:
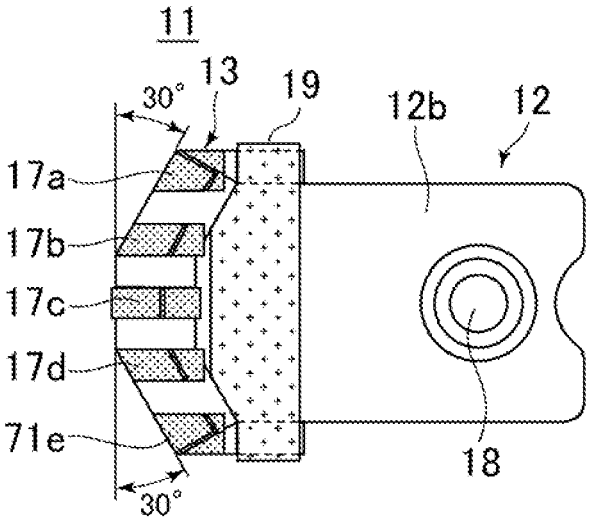
FIGS. 4A-4C are configuration diagrams of the middle-blade cutter bit according to the embodiment of the present invention.
Figure 4B:
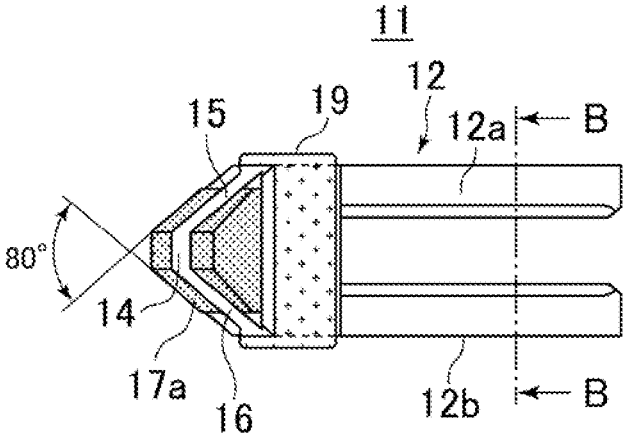
Figure 4C:
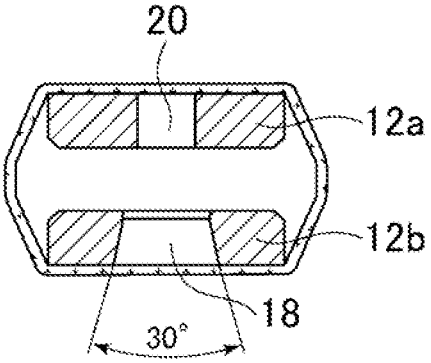

FIGS. 3 and 4A—4C illustrate the configuration of a middle-blade cutter bit according to the embodiment of the present invention. FIG. 3 is a perspective view of the cutter bit, FIG. 4A is a side view thereof, FIG. 4B is a plan view thereof, and FIG. 4C is a cross-sectional view thereof taken along line B-B.

As illustrated in the drawings, a middle-blade cutter bit 11 includes a mounting part 12 constituted by two flat-plate members 12*a* and 12*b* facing each other at a predetermined interval, and an excavation part 13 formed continuously with the mounting part 12 and having a leading end at which a plurality of ultrahard chips 17*a* to 17*e* are disposed at a predetermined interval in a comb shape. The excavation part 13 includes, when a leading end part thereof is viewed from a front side as illustrated in the perspective view of FIG. 3, a central part 14 extending at the center in the longitudinal direction, and a first tilt part 15 and a second tilt part 16 tilted on both sides of the central part 14.

In this example, the first tilt part 15 of the excavation part 13 is formed in a first length at a first tilt angle, the second tilt part 16 of the excavation part 13 is formed in a second length at a second tilt angle, the first tilt angle is 50°, which is equal to the second tilt angle, and the first length is equal to the second length. When the proximity of a leading end thereof is viewed from a side surface as illustrated in FIG. 4A, the excavation part 13 has what is called a substantially fan shape tilted at a tilt angle of 30° upward and downward from a substantial center of the leading end.

A hard building-up 19 is formed in a region of the excavation part 13 in which ultrahard bits 17*a* to 17*e* are not disposed. This functions to reduce abrasion of the excavation part 13 at excavation. Both ends of the first tilt part 15 of the excavation part 13 are tilted at 50° relative to upper and lower surfaces at end parts of the central part 14, and both ends of the second tilt part 16 of the excavation part 13 are tilted at 50° relative to the upper and lower surfaces. This is a structure for parrying earth pressure at excavation by the first tilt part 5 and the second tilt part 16.

Accordingly, although the casing-tube cutter bit according to the conventional technology is applicable to one-directional rotation only and has a shape that allows use of ultrahard chips of one material, the excavation part 13 of the cutter bit 11 according to the present embodiment has such a comb shape that allows use of the ultrahard chips 17*a* to 17*e* of five materials at maximum, and thus one cutter bit is applicable to a wide range of excavation targets.

In addition, since the excavation part 13 has a comb shape and a fan shape, the wide angle of 30° is applied as a contact surface angle for excavation as described above, which can reduce losses of the ultrahard chips 17*a* to 17*e* disposed at the excavation part 13.

In addition, since the excavation part 13 has a comb shape and a fan shape, the right and left sides of the ultrahard chip 17*c* disposed at the center can equally contact an excavation target. As for contact surfaces, one of the first tilt part 15 or the second tilt part 16 serves as a contact surface, and the other reduces excavation earth pressure and impact and withstanding pressure of obstacles such as concrete, steel bars, and steel beams.

The two members 12*a* and 12*b* of the mounting part 12 are provided with openings 18 and 20 for bolt insertion and nut fastening when the cutter bit 11 is mounted on the bit attachment holder 40.

As for materials, the parent material of the mounting part 12 may be SCM440 (chromium/molybdenum steel) or the like, and the material of each of the ultrahard chips 17*a* to 17*e* may be E3 (material name: MG30), E4 (material name: MG40), E5 (material name: MG50), E6 (material name: MG60), or the like in JIS classification codes, or G4 (CIS material code: VC-40), G5 (CIS material code: VC-50), or the like in CIS standards. The material of the hard building-up 19 may be HF (hard facing) 800 or the like.

External-Blade Cutter Bit

Figure 5:
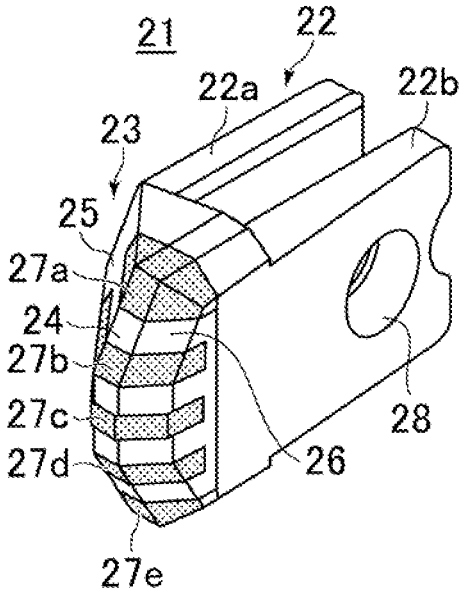
FIG. 5 is a perspective view of an external-blade cutter bit according to the embodiment of the present invention.
Figure 6A:
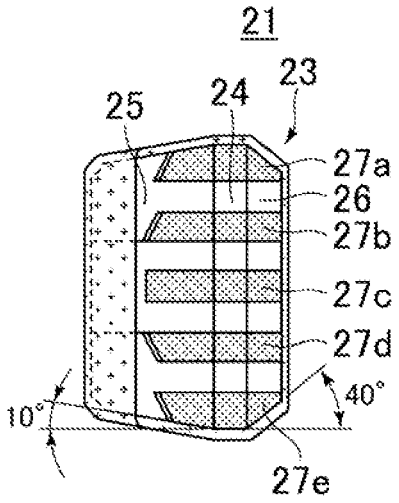
FIGS. 6A-6D are configuration diagrams of the external-blade cutter bit according to the embodiment of the present invention.
Figure 6B:
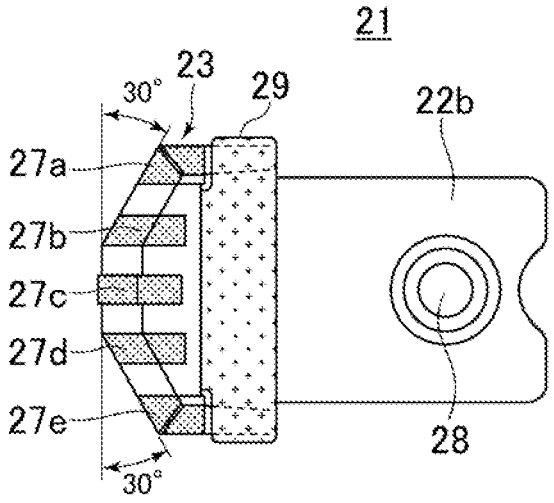
Figure 6C:
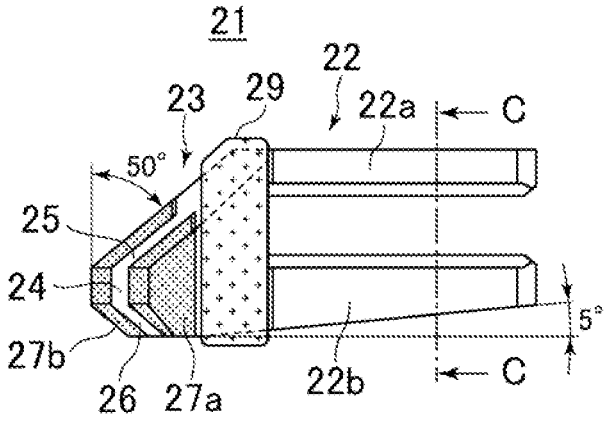
Figure 6D:
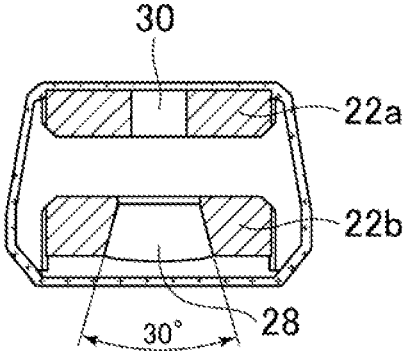

FIGS. 5 and 6A—6D illustrate the configuration of an external-blade cutter bit according to the embodiment of the present invention. FIG. 5 is a perspective view of the cutter bit, FIG. 6A is a front view thereof, FIG. 6B is a side view thereof, FIG. 6C is a plan view thereof, and FIG. 6D is a cross-sectional view thereof taken along line C-C.

As illustrated in the drawings, an external-blade cutter bit 21 includes a mounting part 22 constituted by two flat-plate members 22*a* and 22*b* facing each other at a predetermined interval, and an excavation part 23 formed continuously with the mounting part 22 and having a leading end at which a plurality of ultrahard chips 27*a* to 27*e* are disposed at a predetermined interval in a comb shape. The excavation part 23 includes, when a leading end thereof is viewed from a front side as illustrated in FIG. 6A, a central part 24 extending at the center in the longitudinal direction, and a first tilt part 25 and a second tilt part 26 tilted on both sides of the central part 24.

In this example, the first tilt part 25 of the excavation part 23 is formed in a first length at a first tilt angle, the second tilt part 26 of the excavation part 23 is formed in a second length at a second tilt angle, the first tilt angle is 50°, which is equal to the second tilt angle, and the first length is longer than the second length. When the proximity of a leading end thereof is viewed from a side surface as illustrated in FIG. 6B, the excavation part 23 has what is called a substantially fan shape tilted at a tilt angle of 30° upward and downward from a substantial center of the leading end.

A hard building-up 29 is formed in a region of the excavation part 23 in which the ultrahard bits 27*a* to 27*e* are not disposed. This functions to reduce abrasion of the excavation part 23 at excavation. Both ends of the first tilt part 25 of the excavation part 23 are tilted at 10° relative to upper and lower surfaces at end parts of the central part 24, and both ends of the second tilt part 26 of the excavation part 23 are tilted at 40° relative to the upper and lower surfaces. This is a structure for parrying earth pressure at excavation by the second tilt part 26 and causing excavated earth and sand to smoothly flow.

Accordingly, although the casing-tube cutter bit according to the conventional technology is applicable to one-directional rotation only and has a shape that allows use of ultrahard chips of one material, the excavation part 23 of the cutter bit 21 according to the present embodiment has such a comb shape that allows use of the ultrahard chips 27*a* to 27*e* of five materials at maximum, and thus one cutter bit is applicable to a wide range of excavation targets.

In addition, since the excavation part 3 has a comb shape and a fan shape, the wide angle of 30° is applied as a contact surface angle for excavation as described above, which can reduce losses of the ultrahard chips 27*a* to 27*e* disposed at the excavation part 23.

In addition, since the excavation part 23 has a comb shape and a fan shape, the right and left sides of the ultrahard chip 27*c* disposed at the center can equally contact an excavation target. As for contact surfaces, each surface on the second tilt part 26 side serves as an inner contact surface, and the first tilt part 25 reduces excavation earth pressure and impact and withstanding pressure of obstacles such as concrete, steel bars, and steel beams.

One member 22*b* of the mounting part 22 continuous with the second tilt part 26 side of the excavation part 23 has an outer surface tilted inward at a tilt angle of 5°. Accordingly, internal pressure and external pressure applied to the cutter bit 21 are reduced. Specifically, the tilt angle is set to be 5° with taken into consideration the degree of protrusion from outer and inner plates of the casing tube and reduction of earth pressure on the casing tube.

The two members 22*a* and 22*b* of the mounting part 22 are provided with openings 28 and 30 for bolt insertion and nut fastening when the cutter bit 21 is mounted on the bit attachment holder 40.

As for materials, the parent material of the mounting part 22 may be SCM440 (chromium/molybdenum steel) or the like, and the material of each of the ultrahard chips 27*a* to 27*e* may be E3 (material name: MG30), E4 (material name: MG40), E5 (material name: MG50), E6 (material name: MG60), or the like in JIS classification codes, or G4 (CIS material code: VC-40), G5 (CIS material code: VC-50), or the like in CIS standards. The material of the hard building-up 9 may be HF (hard facing) 800 or the like.

Bit Attachment Holder

Figure 7:
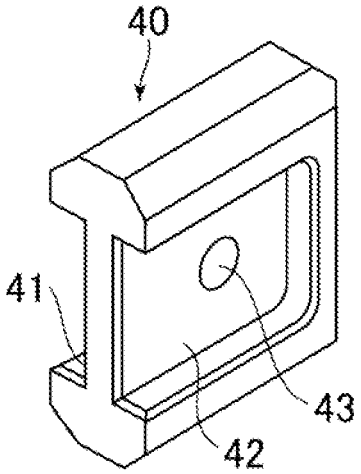
FIG. 7 is a perspective view of a bit attachment holder.
Figure 8A:
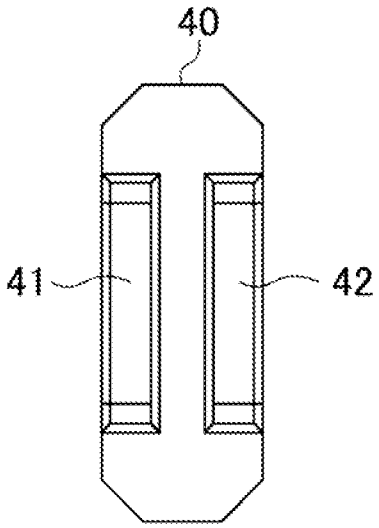
FIGS. 8A and 8B are configuration diagrams of the bit attachment holder.
Figure 8B:
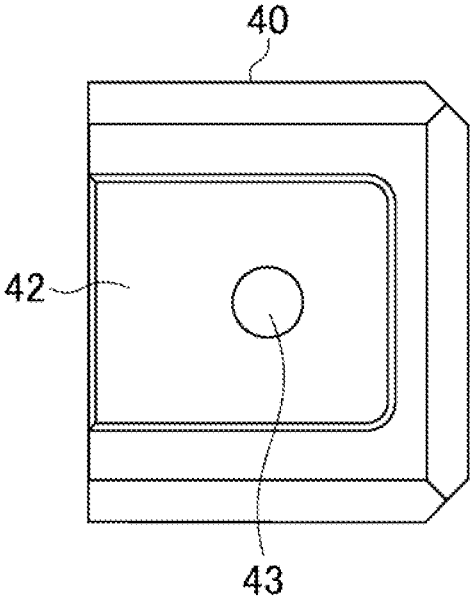

FIGS. 7 and 8A—8B illustrate the configuration of the bit attachment holder. FIG. 7 is a perspective view of the bit attachment holder, FIG. 8A is a front view thereof, and FIG. 8B is a side view thereof.

As illustrated in the drawings, the bit attachment holder 40 includes recesses 41 and 42 on right and left planes, respectively, and a bolt insertion opening 43 is provided through the recesses 41 and 42. With such a configuration, when the cutter bit 1 is set, the members 2*a* and 2*b* of the mounting part 2 are engaged with the recesses 41 and 42, and the openings 8 and 10 are positioned with respect to the opening 43 of the bit attachment holder 40, and then subjected to bolt insertion and nut fixation. The other cutter bits 11 and 21 are attachable in the same manner.

Casing Tube

Figure 9:
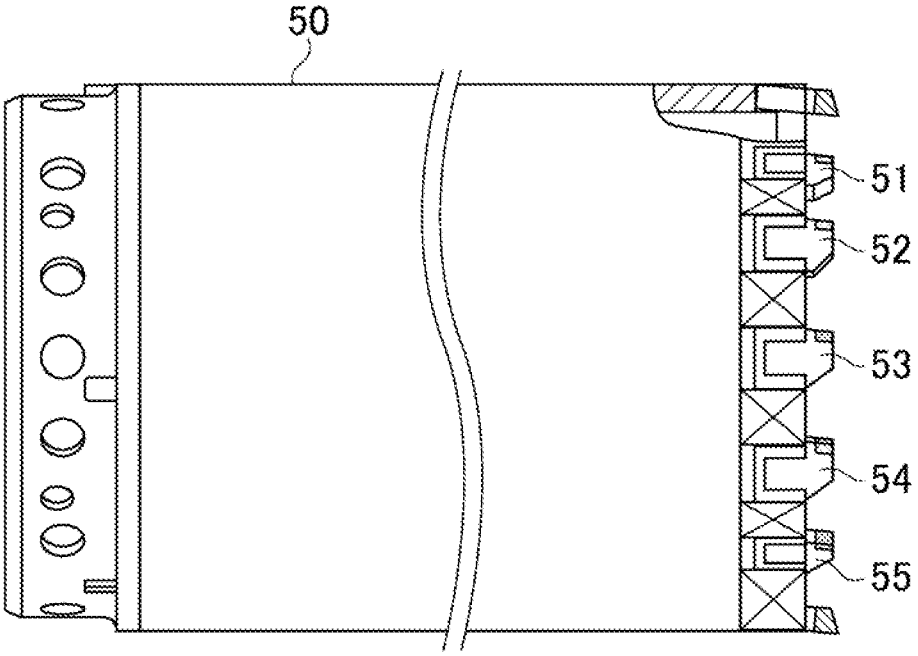
FIG. 9 is a configuration diagram of a casing tube.

FIG. 9 illustrates the configuration of the casing tube.

As illustrated in the drawing, external blades, middle blades, and inner blades (reference signs 51 to 55, for example) can be mounted on a leading end of a casing tube 50. In this case, the attachment numbers and disposition of inner blades, external blades, and middle blades may be optionally determined depending on an excavation target.

Excavation Process

The process of excavation or the like by using a casing tube will be described below with reference to FIGS. 10A-10F.

Figure 10F:
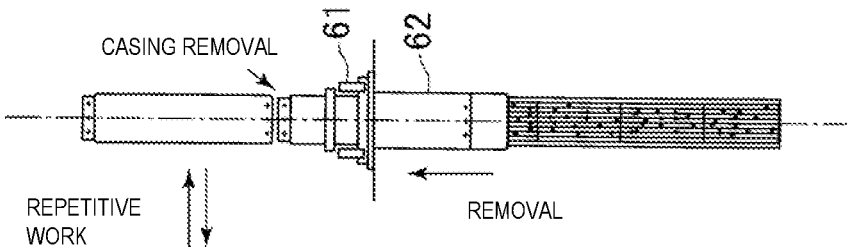
FIGS. 10A-10F are diagrams for description of the process of excavation or the like by using the casing tube.
Figure 10E:
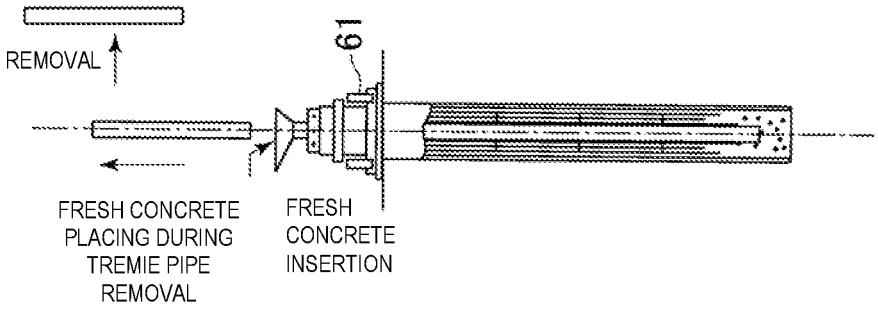
Figure 10D:
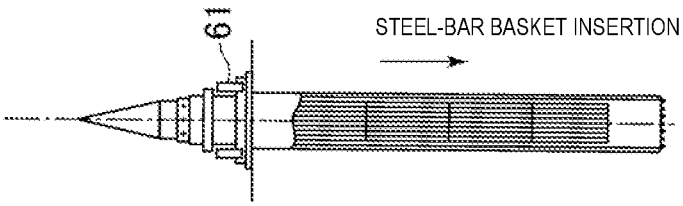
Figure 10C:
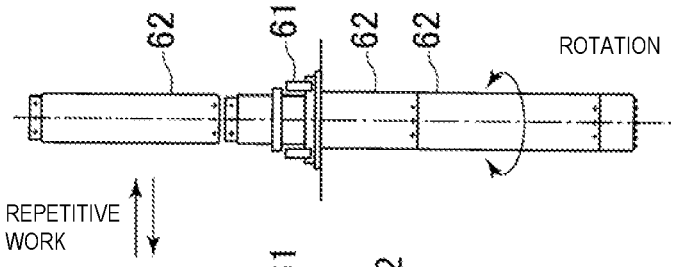
Figure 10B:
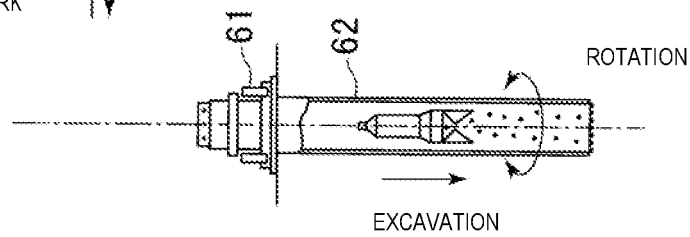
Figure 10A:
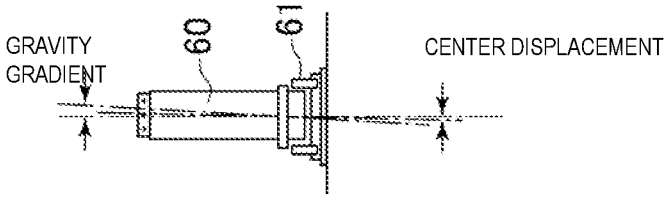

First, a casing tube 62 is mounted on a full-rotation tubing device 60 disposed at an excavation position (refer to FIG. 10A), and the casing tube 62 is rotated to perform excavation work (refer to FIG. 10B). Subsequently, another casing tube is set to perform repetitive work of excavation through rotation (refer to FIG. 10C). Then, a steel-bar basket is inserted into a hole formed through excavation (refer to FIG. 10D). Fresh concrete placing is performed while a tremie pipe is removed (refer to FIG. 10E). The casing tube 62 is removed (refer to FIG. 10F). The cutter bits 1, 11, and 21 as described above are mounted on the leading end of the first casing tube 62 in accordance with the type of an excavation target and the like. Since the first casing tube constantly rotates in the earth, the inner side, outer side, and leading end side thereof serve as contact surfaces at excavation. The casing tube 62 is rotatable in both directions.

Although the embodiment of the present invention is described above, the present invention is not limited thereto but may be modified and changed in various kinds of manners without departing from the scope of the invention.

For example, a casing-tube cutter bit according to the present embodiment is applicable to, for example, earth obstacle dismantlement work, and the application reduces cracking, dropping, and abrasion of ultrahard chips in work of dismantling earth obstacles such as a steel-bar concrete structure, a steel-pipe poling board, and H steel as compared to the conventional technology. In addition, the casing-tube cutter bit is also applicable to bounding-stone layer excavation, and in this case, cracking, dropping, and abrasion of ultrahard chips in excavation at a bounding-stone layer of river stones and hard rocks are reduced as compared to the conventional technology.

The invention claimed is:

1. A casing-tube cutter bit comprising:

a mounting part having first and second members, each of the first and second members being substantially plate-shaped, the first and second members being spaced apart from each other along a first direction;

an excavation part continuously formed with the mounting part, the excavation part being substantially polygonal-pyramid-shaped and having a base and a ridge outwardly opposite to each other, the base having first and second side areas, the first and second members of the mounting part continuously extending from the first and second side areas of the base, respectively; and a plurality of ultrahard chips disposed in the excavation part and exposed to an outside of the excavation part, each of the plurality of ultrahard chips extending along the first direction to cross the ridge, the plurality of ultrahard chips being spaced apart from one another along a second direction perpendicular to the first direction, wherein the ridge of the excavation part has a plane extending along the first direction and the second direction, the excavation part has first and second tilt surfaces, the first tilt surface extends from the ridge toward the first member of the mounting part in a first length at a first tilt angle with respect to the plane, and the second tilt surface extends from the ridge toward the second member of the mounting part in a second length at a second tilt angle with respect to the plane, the first tilt angle is equal to the second tilt angle, and the first length is shorter than the second length, and at least one of the plurality of ultrahard chips is made of a material different from materials of the other of the plurality of ultrahard chips.

2. The cutter bit according to claim 1, wherein each of the first and second tilt angles is 50°.

3. The cutter bit according to claim 1, wherein the plane of the ridge has first and second edges opposite to each other along the second direction, and the ridge of the excavation part further has third and fourth tilt surfaces, the third tilt surface extends from the first edge of the plane toward one sides of the first and second members of the mounting part at a third tilt angle with respect to the plane, and the fourth tilt surface extends from the second edge of the plane toward the other sides of the first and second members of the mounting part at a fourth tilt angle with respect to the plane.

4. The cutter bit according to claim 3, wherein each of the third and fourth tilt angles is 30°.

5. The cutter bit according to claim 1, wherein an outer surface of the first member of the mounting part is tilted inward at a tilt angle of 5°, and the outer surface of the first member continuously extends from a side surface of the excavation part having the first tilt surface.

6. A casing-tube cutter bit comprising:

a mounting part having first and second members, each of the first and second members being substantially plate-shaped, the first and second members being spaced apart from each other along a first direction;

an excavation part continuously formed with the mounting part, the excavation part being substantially polygonal-pyramid-shaped and having a base and a ridge outwardly opposite to each other, the base having first and second side areas, the first and second members of the mounting part continuously extending from the first and second side areas of the base, respectively; and a plurality of ultrahard chips disposed in the excavation part and exposed to an outside of the excavation part, each of the plurality of ultrahard chips extending along the first direction to cross the ridge, the plurality of ultrahard chips being spaced apart from one another along a second direction perpendicular to the first direction, wherein the ridge of the excavation part has a plane extending along the first direction and the second direction, the excavation part has first and second tilt surfaces, the first tilt surface extends from the ridge toward the first member of the mounting part in a first length at a first tilt angle with respect to the plane, and the second tilt surface extends from the ridge toward the second member of the mounting part in a second length at a second tilt angle with respect to the plane, the first tilt angle is equal to the second tilt angle, and the first length is equal to the second length, and at least one of the plurality of ultrahard chips is made of a material different from materials of the other of the plurality of ultrahard chips.

7. The cutter bit according to claim 6, wherein each of the first and second tilt angles is 50°.

8. The cutter bit according to claim 6, wherein the plane of the ridge has first and second edges opposite to each other along the second direction, and the ridge of the excavation part further has third and fourth tilt surfaces, the third tilt surface extends from the first edge of the plane toward one sides of the first and second members of the mounting part at a third tilt angle with respect to the plane, and the fourth tilt surface extends from the second edge of the plane toward the other sides of the first and second members of the mounting part at a fourth tilt angle with respect to the plane.

9. The cutter bit according to claim 8, wherein each of the third and fourth tilt angles is 30°.

10. The cutter bit according to claim 6, wherein an outer surface of the first member of the mounting part is tilted inward at a tilt angle of 5°, and the outer surface of the first member continuously extends from a side surface of the excavation part having the first tilt surface.

* * * * *